US007160231B2

(12) United States Patent
Kazemi

(10) Patent No.: US 7,160,231 B2
(45) Date of Patent: Jan. 9, 2007

(54) PORTABLE EXERCISE DEVICE AND METHOD OF PREVENTING LACTIC-ACID BUILD-UP

(76) Inventor: Mohsen Kazemi, 11 Learmont Drive, Etobicoke, Ontario (CA) M9R 2E6

( * ) Notice: Subject to any disclaimer, the term of this patent is extended or adjusted under 35 U.S.C. 154(b) by 0 days.

(21) Appl. No.: 10/923,671

(22) Filed: Aug. 24, 2004

(65) Prior Publication Data

US 2005/0282687 A1 Dec. 22, 2005

(51) Int. Cl.
*A63B 22/06* (2006.01)

(52) U.S. Cl. ..... 482/60

(58) Field of Classification Search ..... 482/51, 482/52, 57, 63, 60; 601/36
See application file for complete search history.

(56) References Cited

U.S. PATENT DOCUMENTS

| | | | | |
|---|---|---|---|---|
| 4,846,156 | A * | 7/1989 | Kopnicky | 601/36 |
| 5,108,092 | A | 4/1992 | Hurst | 482/60 |
| 5,232,420 | A * | 8/1993 | Terauds | 482/53 |
| 5,595,553 | A | 1/1997 | Rodgers, Jr. | 482/51 |
| 5,806,379 | A | 9/1998 | Nagano | |
| 6,063,008 | A * | 5/2000 | McBride et al. | 482/52 |
| 6,090,013 | A | 7/2000 | Eschenbach | 482/52 |
| 6,159,132 | A * | 12/2000 | Chang | 482/57 |
| 6,178,850 | B1 | 1/2001 | Hilley | |
| 6,453,770 | B1 * | 9/2002 | Ching | 74/594.5 |
| 6,661,136 | B1 | 12/2003 | Lee | 310/74 |
| 6,918,860 | B1 * | 7/2005 | Nusbaum | 482/57 |

FOREIGN PATENT DOCUMENTS

| | | |
|---|---|---|
| CA | 2440039 | 9/2002 |
| CA | 2372271 | 3/2003 |

OTHER PUBLICATIONS

Ahmaidi S., et al., "Effects of active recovery on plasma lactate and anaerobic power following repeated intensive exercise", *Med. Sci. Sports Exerc.*, (Apr. 1996), 28(4):450-456.

Dupont, G., et al., "Performance for short intermittent runs: Active recovery vs. passive recovery", *Eur. J. Appl. Physiol.*, (2003) 89(6):548-554.

Gupta, S., et al., "Comparative study of lactate removal in short term massage of extremities, active recovery and a passive recovery period after supramaximal exercise seesions", *Int. J. Sports Med.*, (Feb. 1996), 17(2):106-110.

Lau, S., et al., "Comparison of active and passive recovery of blood lactate and subsequent performance of repeated work bouts in ice hockey players", *J. Strength Cond. Res.*, (2001) 15(3):367-371.

Monedero, J., et al., "Effect of Recovery Interventions on Lactate Removal and Subsequent Performance", *Int. J. Sports Med.*, (2000) 21:593-597.

Jenni, M. et al., "Effect of active and passive recovery on blood lactate and performance during simulated competition in high level gymnasts", *Can. J. Appl. Physiol.*, (Apr. 2003), 28(2):240-256.

(Continued)

*Primary Examiner*—Jerome Donnelly
*Assistant Examiner*—Tam Nguyen
(74) *Attorney, Agent, or Firm*—Marcelo K. Sarkis; Ivor M. Hughes; Neil H. Hughes

(57) ABSTRACT

An exercise device comprising a pedal adapted for use with a skate and having a skate engaging portion disposed therewith.

8 Claims, 7 Drawing Sheets

OTHER PUBLICATIONS

Spierer, D.K., et al., "Effects of Active vs. Passive Recovery on Work Performed During Serial Supramaximal Exercise Tests", *Int. J. Sports Med.*, (2004) 25(2):109-114.

Thiriet, P., et al., "The effect of various recovery modalities on subsequent performance, in consecutive supramaximal exerise", *J. Sports Med. Phys. Fitness*, (Jun. 1993), 33(2):118-129.

Watts, P.B., et al., "Metabolic response during sport rock climbing and the effects of active versus passive recovery", *Int. J. Sports Med.*, (Apr. 2000), 21(3):185-190.

Kennedy, Patrick: newspaper article taken from the Kingston Whig-Standard, Nov. 22, 2003 (www.kingstonfrontenacs.com/news/2003-11-22.html).

* cited by examiner

PORTABLE EXERCISE DEVICE AND METHOD OF PREVENTING LACTIC-ACID BUILD-UP

FIELD OF THE INVENTION

This invention generally relates to therapeutic exercise devices for individuals wearing skates and methods of using such exercise devices for reducing the build-up of lactic acid in such persons.

BACKGROUND OF THE INVENTION

Cardiovascular exercise devices for use by individuals trying to keep in shape are known. There are numerous types and configurations of devices known in the art. Examples of such devices commonly found in the home or gym environment include the treadmill, the stationary exercise cycle, the elliptical trainer and the stair climber. Exemplary devices are disclosed in U.S. Pat. No. 6,661,136; U.S. Pat. No. 6,159,132; U.S. Pat. No. 6,090,013; and U.S. Pat. No. 5,595,553.

These devices when found in the gym environment tend to be large bulky heavy duty machines that do not lend themselves to being easily transported or moved. In the home environment, such devices claiming to be storable, may be cumbersome to handle.

In addition to being used as cardiovascular devices, these exercise machines have also been used to rehabilitate those with lower body or spinal column injuries in order to prevent or reverse the process of muscle atrophy.

The stationary exercise cycle is known to be used by professional athletes during the course of a game during periods of inactivity to keep muscles warm and loose. Such a use is commonly employed in the game of baseball by designated hitters who do not take part in the defensive aspects of the game. *Int. J. Sports Med.* (2004); 25:109–114 and *Int. J. Sports Med.*, (2000); 21:593–597, outline that active recovery, as opposed to passive recovery, aides in the removal of lactate (i.e. lactic acid).

Normally the use of known large scale exercising devices by professional athletes, such as baseball players, requires that the player leave the general vicinity of the playing surface, away from his/her fellow team-mates.

Such devices are not practical for individuals who are wearing skates for example ice and in-line skates (e.g., figure skaters, hockey players) as this requires the removal of the skate prior to exercising and the additional time for replacing of the skate prior to re-entering the skating surface.

Attempts have been made in the art to reduce the size of exercise machines to something that is portable yet still provides the same level of activity of the larger exercising devices.

Canadian Patent Application 2,372,271 discloses a motorized stationary bike that can optionally have a generally low profile and is used primarily for those being rehabilitated. The motor drives the pedals which assist in working of the leg and waist muscles. The pedals of such a device are not conducive to being used by individuals wearing skates.

U.S. Pat. No. 5,108,092 teaches an adjustable non-motorized version of another portable exercise device. It includes a flywheel and an adjustable tensioning screw for regulating the resistance felt by the user. Again such a device can not be utilized by individuals who are wearing skates.

Canadian Patent Application 2,440,039 teaches another portable exercise device for use by disabled individuals that contains a pedal cover that is fixably removable from the pedal itself. The pedal cover provides a larger surface upon which a disabled individual may interact with the exercise device which may otherwise be difficult due to the dexterity needed to use devices with a conventional pedal. Again such a device is unsuitable for use by individuals wearing skates.

It is a primary object of the invention to provide an exercise device for use by individuals wearing skates preferably ice skates or in-line skates.

It is another object of the invention to provide an exercise device that is preferably small and portable.

It is another object of the invention to provide an exercise device that can be used by skaters in the vicinity of a skating surface.

It is yet another object of the invention to provide an exercise device that can be used to prevent lactic acid build-up in skaters preferably said device being located in the vicinity of a skating surface.

It is yet another object of the invention to provide for a method of preventing lactic acid build-up in skaters.

It is yet another object of the invention to provide an adapter for a pedal for use with an exercise device to allow an individual wearing a skate to use the exercise device.

It is yet another object of the invention to provide a pedal that can be used with different sizes of skates.

Further and other objects of the invention will become apparent to one skilled in the art when considering the following summary of the invention and the more detailed description of the preferred embodiments illustrated herein.

SUMMARY OF THE INVENTION

According to one aspect of the invention there is provided an exercise device comprising a pedal adapted for use with a skate, and having a skate engaging portion disposed therewith.

According to another aspect of the invention there is provided an exercise device for an individual wearing a skate comprising two arms, each of said arm being movable to and from a $1^{st}$ position and a $2^{nd}$ position wherein at said $1^{st}$ position, the leg of said individual is substantially straight and at said $2^{nd}$ position, the leg of said individual is bent at the knee, a pedal operably connected to each of said arms and for engagement with said skate, resistance means to provide resistance for opposing motion of said arms; and a controller for regulating said resistance means.

According to another aspect of the invention, there is provided an exercise device for an individual wearing a skate comprising a flywheel for providing resistance to rotary motion, a controller for regulating the resistance to rotation of said flywheel, at least one arm operably connected to said flywheel; and pedals rotatably mounted to each of said at least one arm for engagement with said skate.

According to a further aspect of the invention the pedal further comprises a top containing a groove oriented in a direction to accommodate said skate for engagement therewith, the pedal having a bottom containing a weight for predisposing said bottom in a downwards direction.

According to a further aspect of the invention the pedal carries auxiliary attachments for securing with said skate.

According to a further aspect of the invention the auxiliary attachments comprise a looping member.

According to a further aspect of the invention, the pedal further comprises a generally cylindrical sleeve rotatable around a shaft, said pedal being engageable with said skate by insertion through an opening normally found in the frame of a skate defined by framing members that connect the blade to the boot of said skate.

According to a further aspect of the invention, said pedal further comprises resilient rib members extending radially away from said generally cylindrical sleeve for frictional engagement to said framing members.

According to a further aspect of the invention, said pedal further comprises a generally elliptical sleeve rotatable around a shaft, said elliptical sleeve being engageable with said skate by insertion through an opening normally found in the frame of a skate defined by framing members that connect the blade to the boot of said skate.

According to a further aspect of the invention said pedal further comprises resilient rib members extending radially away from said elliptical sleeve for frictional engagement to said framing members.

According to a further aspect of the invention, the exercise device may further comprise a stationary bicycle.

According to yet another aspect of the invention the exercise device may further comprise a stair climber.

According to a further aspect of the invention the exercise device may further comprise an elliptical trainer.

According to another aspect of the invention, there is provided the use of the aforementioned exercise device for reducing the build-up of lactic acid in an individual wearing a skate.

According to further aspect of the invention, the individual is a hockey player.

According to a further aspect of the invention, the individual is a figure skater.

According to another aspect of the invention, there is provided an adapter for existing pedals of exercise equipment comprising a member having a skate engaging portion and a pedal engaging portion.

In one embodiment of the invention, the skate engaging portion comprises a block containing a groove oriented in the direction of the length of a foot to engage with the blade or wheels of said skate.

In another embodiment of the invention the skate engaging portion comprises a generally elliptical sleeve rotatable around a shaft, said elliptical sleeve being engageable to said skate by insertion through an opening with the frame of skate defined by framing members that connect the blade to the boot of said skate.

The exercise device in one instance may be situated near the players' bench or in the penalty box during a hockey game. Such a device is preferably portable and preferably easily movable between individuals sitting on the bench.

Additionally figure skaters may use such a device while awaiting their turn so as to keep loose prior to their entry to the skating area.

DETAILED DESCRIPTION OF THE PREFERRED EMBODIMENTS

Figure 1:
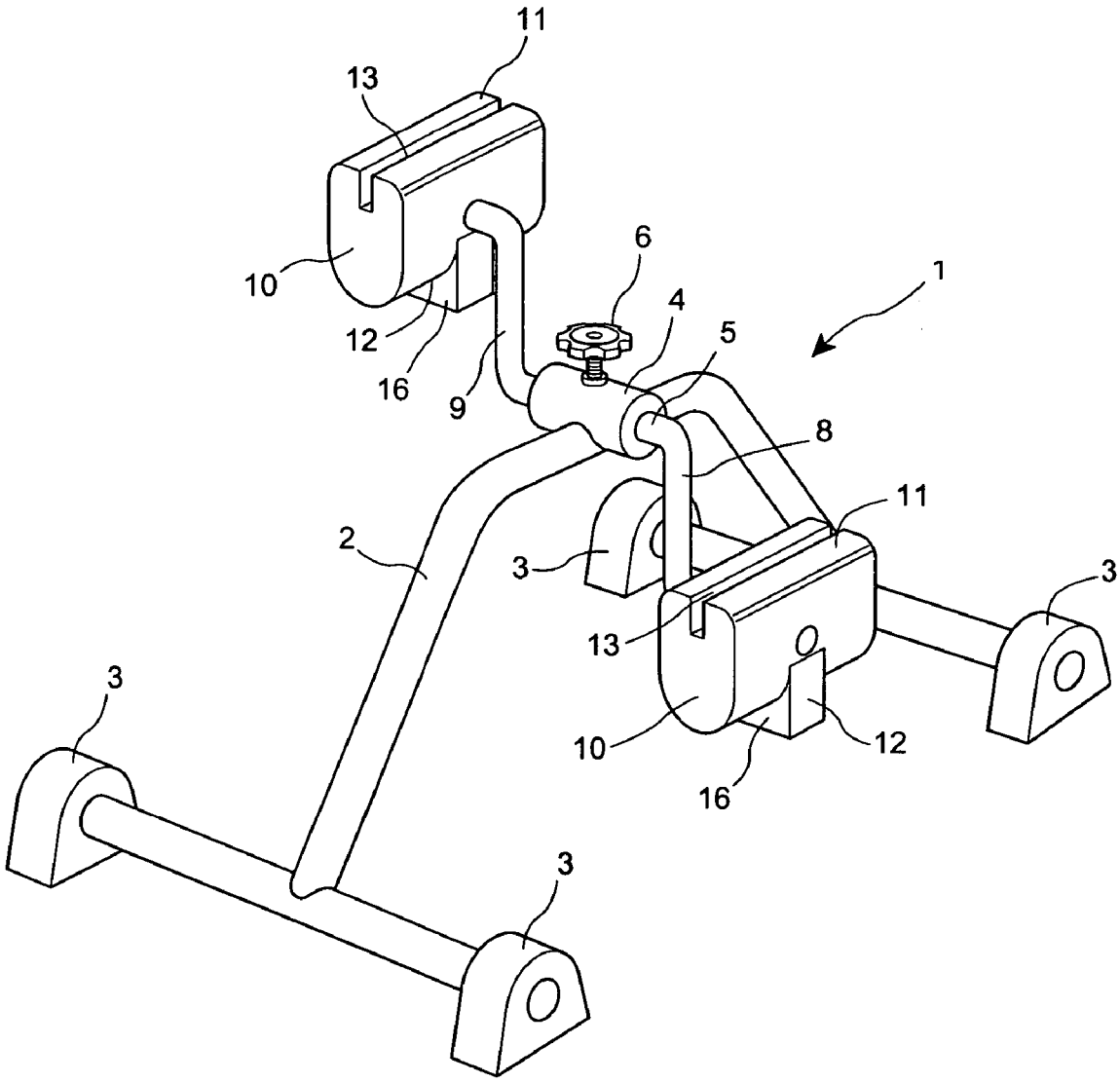
FIG. 1 is a perspective view of the invention illustrating a preferred embodiment of the pedal design.
Figure 2:
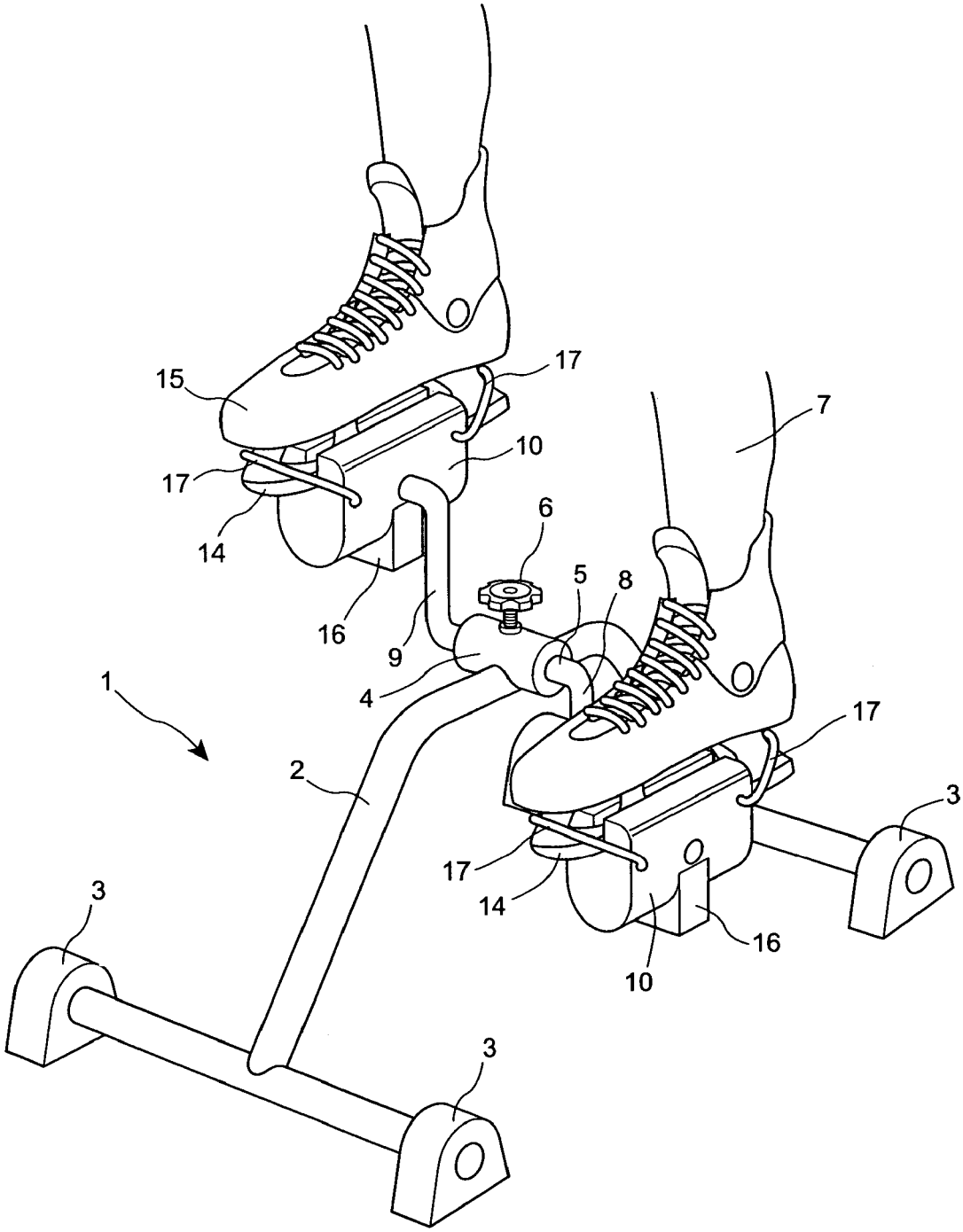
FIG. 2 is a perspective view of a similar device to FIG. 1 with additional features in use with a hockey skate.

Referring now to FIGS. 1 and 2, there is illustrated a cycle type exercise device 1. Other types of exercise devices may also be used, for example elliptical trainers or stair climbers. The cycle type exercise device 1 has a frame 2 with individual floor pads 3, though other methods of support are known such as by the use of suction cups mounted to a frame. Centrally located within the frame 2 is a cylindrical housing 4 having two ends into which is located a weighted flywheel connected to an axle 5. On the exterior of this housing is located a tension screw which frictionally engages the flywheel to provide resistance to a person using it. Other resistance providing methods may also be used. The axle 5 extends from both ends of the housing 4, and integrally connected with the axle 5 on each end are individual crank arms 8, 9. These crank arms 8, 9 are opposed so as to simulate the motion of a bicycle when in use. On the end of each crank arm is located an attachment point for a pedal. A pedal 10 is rotatably mounted to the crank arm 8 and 9. Conventional pedals are generally wider than they are long when compared in reference to the length of a foot. In this regard, in one embodiment of the invention, the pedal is generally longer than it is in wide. The pedal 10 has an upper surface 11 and lower surface 12 in use. The upper surface 11, the skate connecting portion of the pedal, is made from resilient durable material such as rubber or harder thermoplastic material. The durable material contains a slit or groove 13 parallel to the length of a foot into which a skate blade 14 of an ice skate 15 may insertably be secured for friction-fit engagement. The length of the slit or groove 13 is generally similar to the length of a users skate blade 14 though it may be shorter or longer. The width of the groove 13 is generally slightly smaller than the width of a skate blade 14 so as to allow a frictional engagement to the skate blade 14. The resilient material from which the pedal 10 is made can adapt by compression to accommodate widths of blades that are larger than the width of the groove in an unused state. The underside 12 of the pedal carries a weight 16 to orient the skate downward and at the same time causing the opposed skate connection portion of the pedal to be oriented upward. The resilient member may also include protrusions extending upwardly to support the boot of the ice skate, providing reinforcement for securing the skate. Other embodiments may also be used, rather than having those illustrated in the drawings. The device may be V-shaped with the opening of the V providing the groove into which the skate blade 14 is placed, whereas the vertex of the V can carry the weight 16. Other shapes may be used without departing from the scope of the invention. In addition, modifications for use with in-line roller type skates can be made requiring the slit or groove to be wider to accommodate the thicker wheels of such a skate. FIG. 2 demonstrates the addition of auxiliary securing members in the form of loop members of a bungee cord 17 which is disposed at the front and back of the pedal 10 to further secure the ice skate 15 to the pedal 10. The looping members need not be provided at both the front and the back. Acceptable performance may be achieved without these additional securement features. The looping member can also be of alternative construction, such as a flexible and/or stretchable straps.

Figure 3:
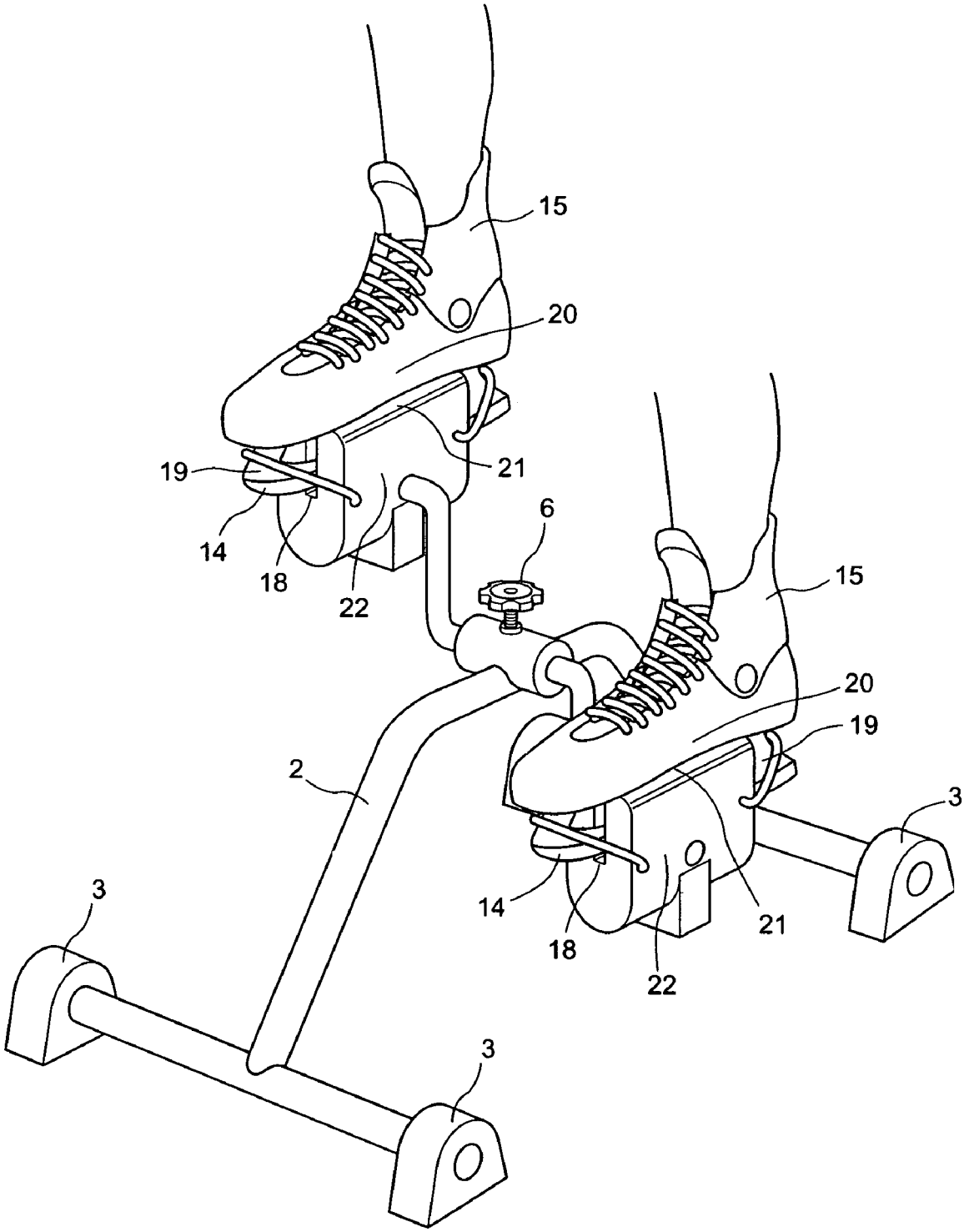
FIGS. 3 is a plan view of another embodiment of a pedal for use with the present invention.

Referring now to FIG. 3, there is illustrated another embodiment of the invention. A groove 18, situated in soft resilient material, is sufficiently deep and sufficiently wide to accommodate the entire height of the blade and skate framing members such that the boot 20 of the hockey skate itself touches the surface 21 of the pedal 22. This embodiment is demonstrated in FIG. 3, wherein the skate 15 is securely fixed to the pedal 22 by frictional forces but the sharpened bottom section of the blade 14 does not come into direct contact with pedal 22. This substantially simulates the feel of a regular pedal when worn with conventional footwear and prevents the edges of the blade 14 from coming into contact with any surfaces that could potentially dull the blade, thus allowing for prolonged use.

Figure 4A:
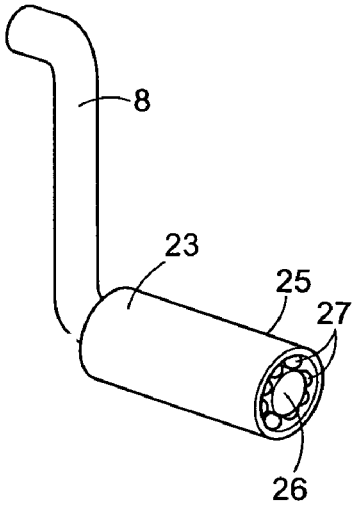
FIGS. 4A and B are plan views of another embodiment of a pedal for use with the present invention.
Figure 4B:
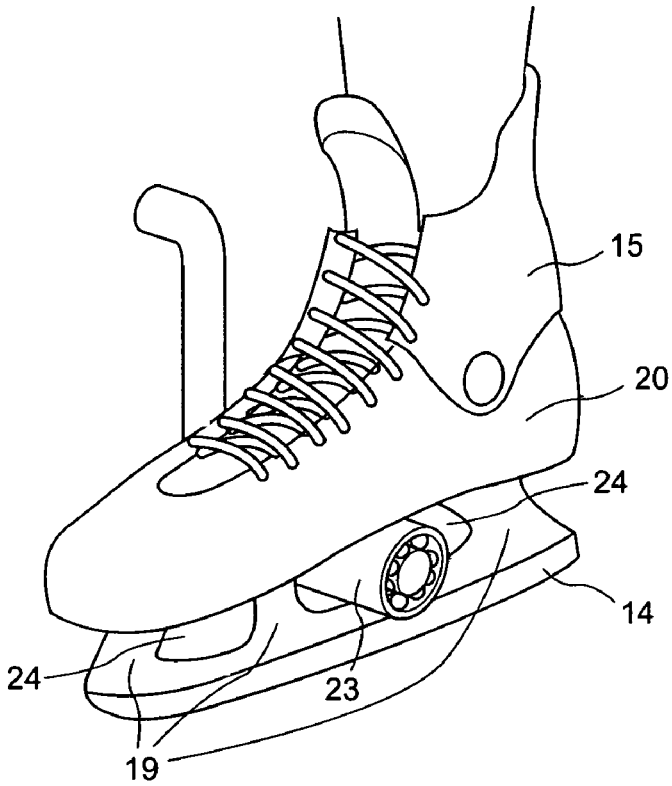

Referring now to FIGS. 4*a* and 4*b*, there is illustrated another embodiment of the invention wherein the pedal design 23 does not engage the ice skate 15 via the skate blade 14. The pedal is a rotatable member that is wider than its length. The pedal 23 when in use is designed to be slidably insertable into a side portion of an ice skate. Conventional ice skates have a boot member 20 into which an individual's foot is placed and a blade member 14 that glides along the ice. The boot member 20 and blade member 14 are connected to one another by framing sections 19 that are attached at the front and back of the boot. Occasionally, there is a third attachment point located between the front and back attachment points. These framing sections 19, depending on the number of attachments points, will provide for a framing opening 24 into which the pedal 23 may be slidably inserted. The pedal 23 consists of a generally cylindrical sleeve 25 that fits over an axle 26 integrally formed with the crank arm 8. Between the axle 26 and the sleeve 25 are located ball bearings 27 that allow the sleeve to freely rotate around the axle 26. Other bearing-type devices are known in the art. The sleeve 25 is made from a resilient material that is radially compressible. This allows the sleeve 25 to be adaptable to various-sized frame openings 24.

Figure 5A:
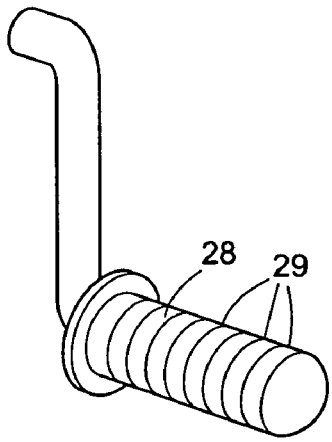
FIGS. 5A and B are plan views of another embodiment of a pedal for use with the present invention.
Figure 5B:
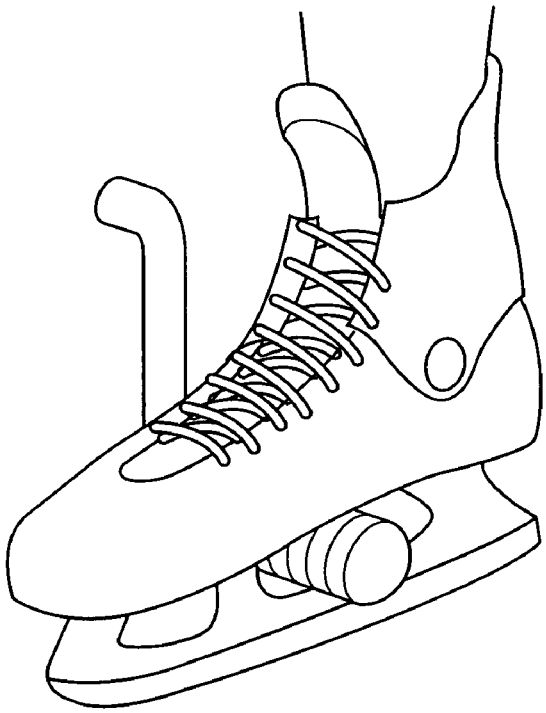

Referring now to FIGS. 5*a* and 5*b*, there is illustrated another embodiment of a pedal design 28 similar to the one illustrated in FIG. 4. The pedal portion 28 additionally contains raised ridges or ribs 29 made from resilient material that are circumferentially mounted on the sleeve. This, coupled with the resilient nature of the sleeve itself, allows for a greater adaptability of the pedal to fit into various-sized skate frame openings.

Figure 6:
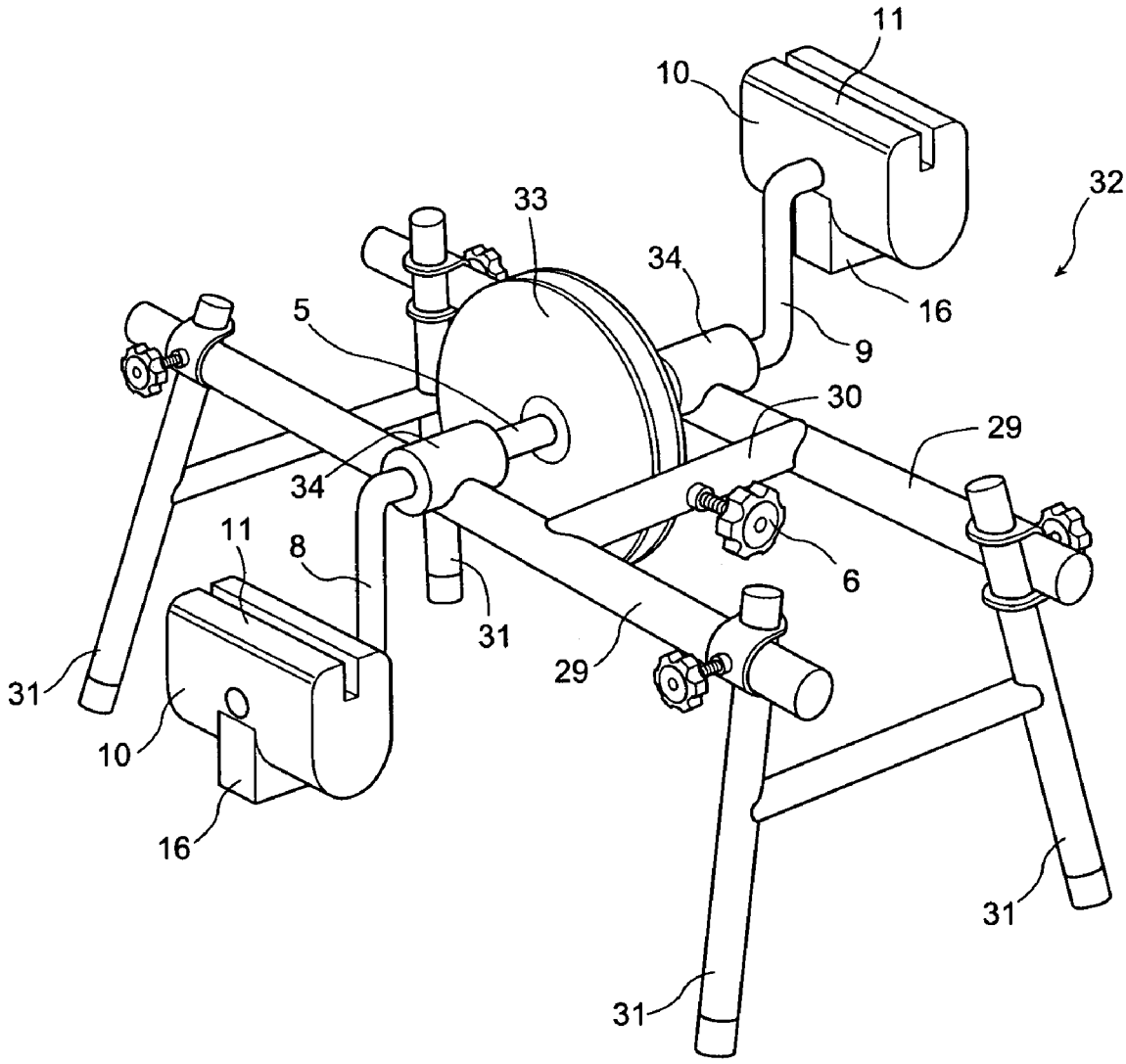
FIG. 6 is a perspective view of another embodiment of the invention.

Referring now to FIG. 6, there is illustrated another embodiment 32 of the present invention having a framing structure with horizontal substantially parallel support members 29. These support members are connected by a cross support member 30. The horizontal support members 29 are adjustably connected to a pair of leg members on each side 31. The adjustability allows for an increase in the height of the device. The device can also be adjusted laterally to provide for an increase in the stability of the device while in use but requiring slightly more space. The device 32 contains a weighted flywheel 33 which provides for continuous resistance to a user. The cross support member 30 has a tensioning screw 6 which frictionally engages the flywheel 33 to provide resistance. The flywheel 33 is centrally connected to an axle 5. The axle 5 has mounted thereon on either side of the flywheel 33, a collar 34 in which the axle 5 can freely rotate. The collar 34 is removably affixed to the horizontal framing members 29. The axle 5 is operably connected on either side of the flywheel to a crank arm 8, 9. Each crack arm 8 and 9 has rotatably attached thereto a pedal 10 adapted for use with a skate. The crank arms 8 and 9 are oriented so that the pedals 10 are substantially in an opposed position. Each pedal contains a weighted portion 16 and a skate engaging portion 11. The pedal 10 is similar to that described in relation to FIG. 1. The weighted portion 16 orients the pedal engaging portion 11 in a substantially upward direction.

Figure 7:
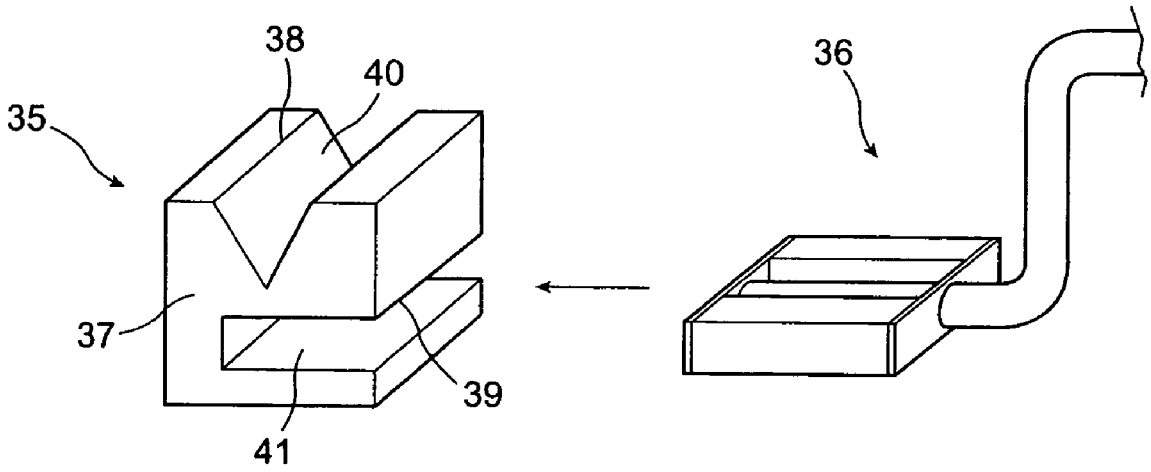
FIG. 7 is a plan view of an adapter for use in another embodiment of the invention.

Referring now to FIG. 7, there is illustrated another embodiment of the invention including a skate accommodating pedal adapter 35, adapted to fit a conventional pedal 36, such as that used in a conventional exercise cycle. The pedal adapter 35 consists of a block 37 having a skate engaging portion 38 and a pedal engaging portion 39. The skate engaging portion 38 contains a slit or groove 40 for accommodating the blade of an ice skate. If the groove 40 is wider, the skate engaging portion 38 can also accommodate the wheels of an in-line skate. The block 37 defines an opening 41 on one side that is sized so that a conventional pedal 36 can be slidably inserted into opening 41. The block 37 is made of a resilient material such that the conventional pedal 36 frictionally engages opening 41. The block may also have auxiliary attachment members such as bungee cords or adjustable straps as described previously for further securement of the skate to the pedal adapter.

Figure 8:
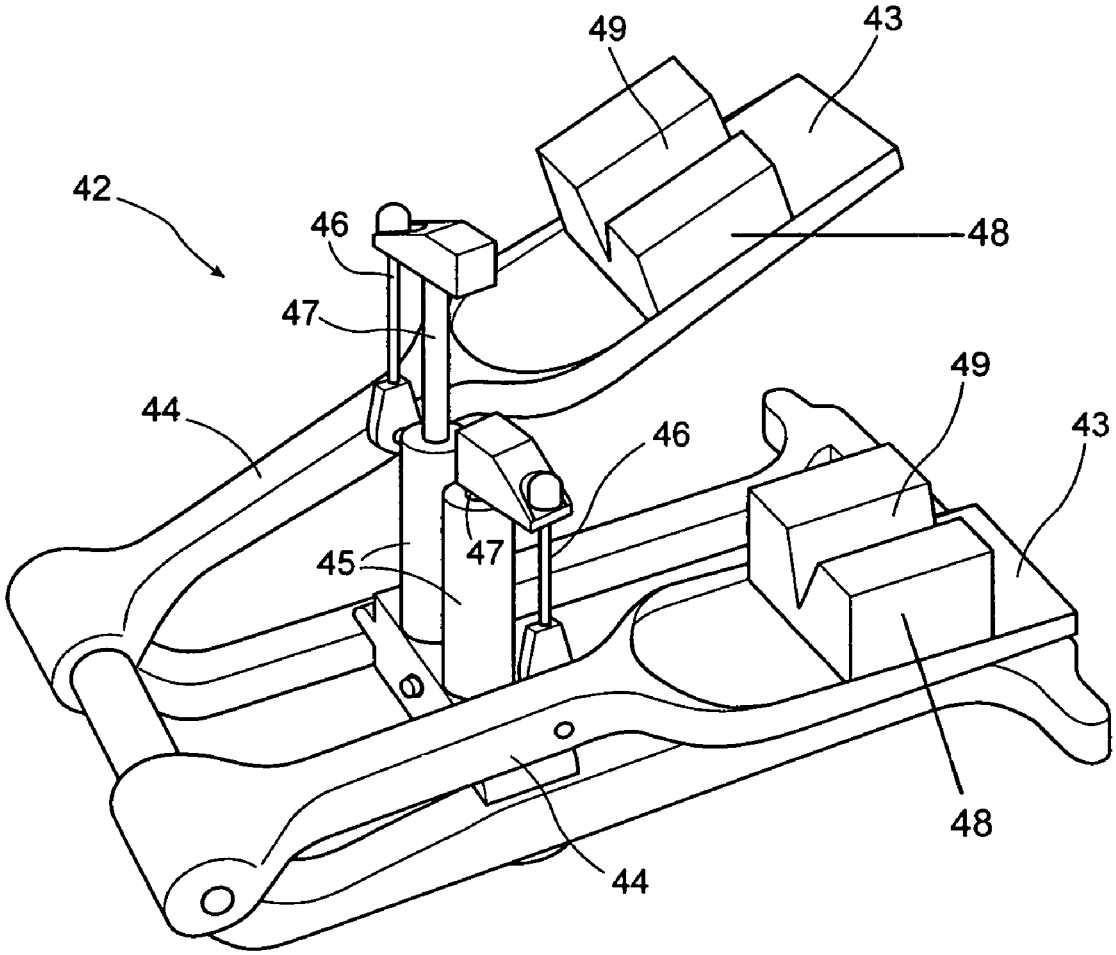
FIG. 8 is a plan view of another embodiment of an exercise device of the present invention.

Referring now to FIG. 8, there is provided another embodiment of the invention wherein a stair climbing stepper device 42 is illustrated and having a skate engaging portion similar to that described previously. The stair climbing stepper device 42 has two stepping platforms 43 with pedal arms 44 pivotally interconnected to a frame 50. The stepping platforms 43 are movable in a substantially vertical direction by the application of forces during the stepping motion by the user. The applied forces are resisted by cylinders 45 operably connected to the pedal arms 44. A pair of cables 46 attached to the pedal arms 44 and the cylinder piston rods 47 interconnects the pedal arm motion to the resistance generated by the cylinder. Each stepping platform 43 has contained thereon a block 48 made from resilient material. The block 48 has contained thereon, a slit or groove 49 to accommodate the blade of an ice skate or the wheels of in-line skates.

Although the invention has been described in reference to specific embodiments thereof, it is evident to one skilled in the art that many alternatives, modifications and variations may be made which embrace all such alternatives, modifications and variations that fall within the scope of the invention as defined by the appended claims.

I claim:

1. An exercise device for use with an individual wearing a skate, said skate comprising at least one blade or at least one wheel, said device comprising:

(a) two arms, each of said arm being movable to and from a $1^{st}$ position and a $2^{nd}$ position;

(b) a pedal operably connected to each of said arms and for frictional engagement with said at least one blade or at least one wheel of said skate of said individual, said pedal further comprising a block, said block being selected from the group consisting of;

(i) a top portion containing a substantially continuous groove made of a resilient material, said groove being substantially longer than its width, said groove being oriented in a direction accommodating said at least one blade or at least one wheel of said skate and said groove having a width substantially smaller than the at least one blade or at least one wheel of said skate to allow for frictional and secured engagement when inserted therewith, and (ii) a top portion containing a substantially continuous groove made of a resilient material, said groove being substantially longer than its width, said groove being oriented in a direction accommodating said at least one blade or at least one wheel of said skate, said groove being sufficiently deep and sufficiently wide such that the skate touches the top portion of at least one said block, and the at least one blade or at wheel does not come into contact with the pedal to allow for frictional and secured engagement when inserted therewith;

(c) resistance means to provide resistance for opposing motion of said arms; and (d) a controller for regulating said resistance means.

2. An exercise device for an individual wearing a skate, said skate comprising at least one blade or at least one wheel, said device comprising:

(a) a flywheel for providing resistance to rotary motion;

(b) a controller for regulating the resistance to rotation of said flywheel;

(c) a pair of arms operably connected to said flywheel; and (d) a pedal operably connected to each of said arms and for frictional engagement with said at least one blade or at least one wheel of said skate of said individual, said pedal further comprising a block, said block being selected from the group consisting of (i) a top portion containing a substantially continuous groove made of a resilient material, said groove being substantially longer than its width, said groove being oriented in a direction accommodating said at least one blade or at least one wheel of said skate and said groove having a width substantially smaller than the at least one blade or at least one wheel of said skate to allow for frictional and secured engagement when inserted therewith, and (ii) a top portion containing a substantially continuous groove said groove being substantially longer than its width, said groove being oriented in a direction accommodating said at least one blade or at least one wheel of said skate, said groove being sufficiently deep and sufficiently wide such that the skate touches the top portion of said block, and the at least one blade or at least one wheel does not come into contact with the pedal to allow for frictional and secured engagement when inserted therewith.

3. The exercise device of claim 1 or 2 wherein said pedal further comprises:

a bottom portion containing a weight for predisposing said bottom portion in a downwards direction.

4. The exercise device of claim 3 wherein said each pedal carries auxiliary attachments for securing with said skate.

5. The exercise device of claim 4 wherein said auxiliary attachments comprise a looping member.

6. The exercise device of claim 1 or 2 wherein the exercise device is a stationary bicycle.

7. The exercise device of claim 1 or 2 wherein the exercise device is a stair climber.

8. The exercise device of claim 1 or 2 wherein the exercise device is an elliptical trainer.

* * * * *